United States Patent [19]

Moll

[11] 4,375,971

[45] Mar. 8, 1983

[54] FOLD ROLLER

[76] Inventor: Richard J. Moll, c/o Dick Moll and Sons, 1957 Pioneer Rd., Bldg. E, Huntingdon Valley, Pa. 19006

[21] Appl. No.: 288,035

[22] Filed: Jul. 29, 1981

Related U.S. Application Data

[63] Continuation-in-part of Ser. No. 178,861, Aug. 18, 1980, abandoned.

[51] Int. Cl.[3] ..... B65H 45/04; B65H 45/18; B65H 45/14

[52] U.S. Cl. ..... 493/442; 29/121.1; 100/176; 493/420

[58] Field of Search ..... 493/442–445, 493/419–421; 29/121.2, 121.1; 100/176; 271/272

[56] References Cited

U.S. PATENT DOCUMENTS

| | | | |
|---|---|---|---|
| 1,786,190 | 12/1930 | Busch | 29/121.2 X |
| 1,793,202 | 2/1931 | Wolstenholme . | |
| 1,938,444 | 12/1933 | Vedder | 100/176 X |
| 2,434,820 | 1/1948 | Tifft . | |
| 3,019,014 | 1/1962 | Miksis | 493/442 |
| 3,332,131 | 7/1967 | Weiler . | |
| 3,447,221 | 6/1969 | Odiorne . | |
| 3,788,638 | 1/1974 | Lehmann | 271/272 |
| 3,796,423 | 3/1974 | Shuster | 493/421 |
| 3,937,919 | 2/1976 | Clerx et al. . | |
| 4,016,811 | 4/1977 | Zavodny . | |

*Primary Examiner*—A. J. Heinz

*Attorney, Agent, or Firm*—Zachary T. Wobensmith, 2nd; Zachary T. Wobensmith, III

[57] ABSTRACT

A fold roller is disclosed for use in paper folding machines, to rip sheets of paper advanced for folding which roller includes a metal core with a resilient sleeve bonded thereto, the surface of the sleeve having ribs with flat faces separated by helical grooves thereon from one end to the other, providing for paper folding with reduced side slip and expelling debris picked up from the surface of the sheets of paper while maintaining constant grip.

5 Claims, 3 Drawing Figures

FOLD ROLLER

CROSS REFERENCE TO RELATED APPLICATIONS

This application is a continuation in part of my prior application for FOLD ROLLER, filed Aug. 18, 1980, Serial No. 178,861 now abandoned.

BACKGROUND OF THE INVENTION

1. Field of the Invention

The invention relates to rollers for paper folding machines and more particularly to such a roller with a resilient ribbed end to end surface for self cleaning.

2. Description of the Prior Art

In folding machines it is important that the sheets of paper to be folded are advanced precisely and without slippage or delay. Some of the paper stock that is folded varies in finish, weight and composition and may have a paper dust and offset press spray binder coating material on the surface which often causes problems with many of the rollers currently in use. A common roller for paper folding is of cylindrical configuration of steel and with transverse grooves. The surface coating material and the paper tends to dull the grooves in the rollers.

The U.S. Pat. to Wolstenholme, No. 1,793,202, shows a roller for applying color or printing fluid to the surface of a printing roller. The Wolstenholme roller uses an aluminum cylinder covered with a layer of rubber with intersecting grooves to form protuburances but does not have the ribbed resilient surface of my invention, is intended to retain material therein rather than being self cleaning, and would not be suitable for use with paper folding machines.

The U.S. Pat. to Tifft, No. 2,434,820, shows a loom temple roller formed of a core of wood with a cylindrical sleeve wrapped therearound and slit end to end. The Tifft roller would not properly advance paper sheets for folding and would tend to accumulate debris.

The U.S. Pat. to Weiler, No. 3,332,131, shows a sleeve for fiberglass resin rollers which has a coarse spiral groove extending end to end. The Weiler roller surface is rigid, would not be suitable for advancing sheets of paper for folding and suffers from other shortcomings.

The U.S. Pat. to Odiorne, No. 3,447,221, shows a roller structure and method of manufacture that involves a knurled metal core covered with an elastomer that is ground to uncover the peaks of the knurling. The Odiorne structure is expensive, would have a short service life and suffers from other shortcomings that would preclude its use with paper folding machines.

The U.S. Pat. to Clerx et al., No. 3,937,919, shows a fixing device which includes an elastic roller with surface grooves or ribs that have a scraping knife associated therewith to prevent sticking. The Clerx et al. structure is not suitable for paper advance for folding.

The U.S. Pat. to Zavodny, No. 4,016,811, shows a grooved roller of metal which has closely spaced spiral grooves for pick up of the fluid to be transferred. The roller of Zavodny is formed of metal treated to be water receptive, lacks resiliency at its surface and accordingly is not self cleaning and would not be suitable for paper advance for folding.

It has also been proposed to employ smooth surfaced rubber rollers but these have a tendency to accumulate debris and particularly offset press spray barrier which renders them unsatisfactory.

It has also been proposed to provide rollers having circumferential longitudinally grooved or knurled metal sections with interposed rings of smooth surface urethane but these rollers also have a tendency to collect debris including offset press spray barrier which renders them unsatisfactory.

The structure of my invention provides a roller with a resilient outer surface having flat outer faces separated by helical grooves that provide superior sheet advance and control and improved gripping capabilities, does not clog with debris, and has other advantages.

SUMMARY OF THE INVENTION

In accordance with the invention an improved fold roller is provided with a resilient outer surface having flat outer surfaces separated by grooves running end to end for advancing sheets of paper for folding.

The principal object of the invention is to provide a fold roller with improved performance capabilities.

A further object of the invention is to provide a fold roller that can be easily rebuilt to extend its service life.

A further object of the invention is to provide a fold roller whose surface is self cleaning and does not accummulate debris.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Figure 1:
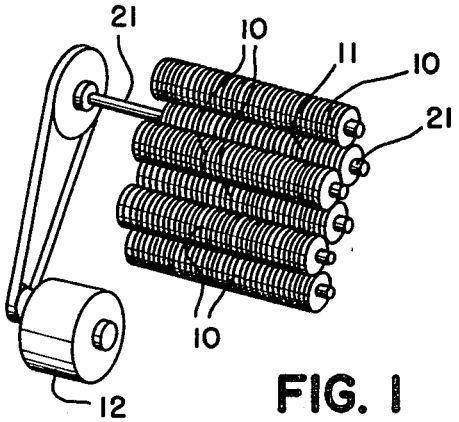
FIG. 1 is a diagrammatic view of a plurality of rollers including a fold roller, in phantom showing the roller of my invention in place in paper folding.

Referring now more particularly to the drawings and FIG. 1 thereof, a plurality of rollers 10 are shown, at least one of which, as at 11, is a driven fold roller, rotated by a driving motor 12. Either six or four rollers 10 are commonly employed. It is customary to employ fold plates to determine the location of the fold but these have been omitted in the interest of clarity.

Figure 2:
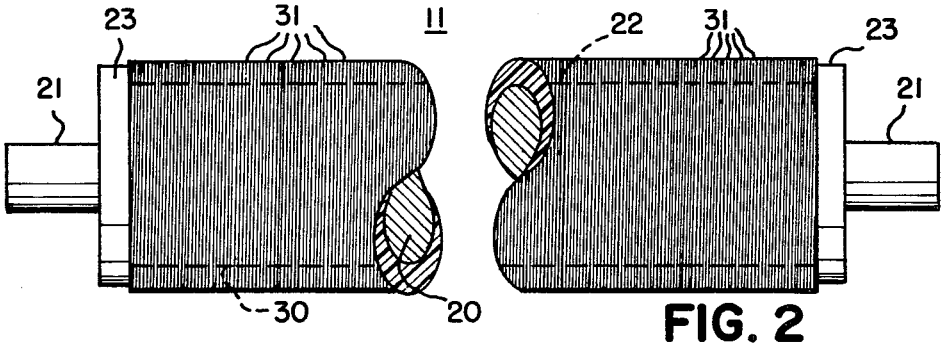
FIG. 2 is a side elevational view, enlarged, of a roller in accordance with the invention broken away to show details of construction.
Figure 3:
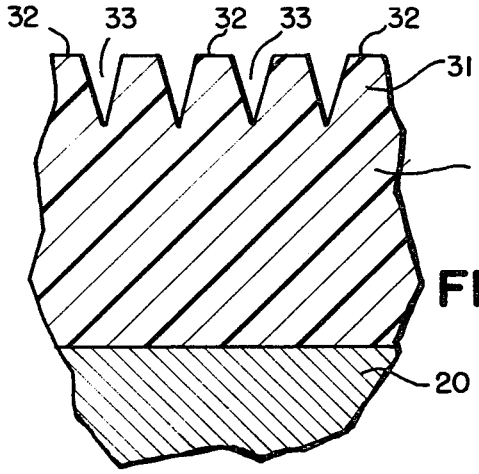
FIG. 3 is a fragmentary view, enlarged, of a portion of the roller of my invention.

The fold roller 10, in accordance with the invention is more fully illustrated in FIGS. 2 and 3 and includes a core 20 with end shafts 21 which are carried in bearings (not shown). The core is cylindrical and preferably formed of steel with a center section 22 and end or band portions 23 of larger diameter than the center section 22, and which end portions 23 may be secured to the center section 22 or made integral therewith, if desired, and in the preferred embodiment are $\frac{1}{8}$ inch larger in diameter than the center section 22.

Between the end or band portions 23 and around the center section 22 a covering 30 is provided of urethane capable of being vulcanized and being machinable. The urethane after vulcanization has a durometer in the range from 60 to 70, and is preferably 65. The covering 30 is of a thickness of approximately one eighth of an inch and after vulcanization to secure adherence is ground to a diameter two or three thousandths of an inch oversize and so as to be of larger diameter than the band portions 23.

The covering 30 has helical grooves 33 cut therein so that the ribs 31 have flat outer faces 32 separated by the helical grooves 33 extending from one end to the other.

The flat outer faces 32 preferably have a width of about that of the groove 33 or slightly smaller. For a roller diameter of one and three quarter inches and a roller diameter of one and one half inches, the grooves 33 can be spaced of the order of 16 per inch and of a depth of about thirty thousandths of an inch which have been found satisfactory.

The covering 30 can easily be replaced when unserviceable thereby maintaining the cost of operation at a low level.

The flat faces 32 separated by the grooves 33 running helically from end to end on the roller 10 because of their resiliency act to expel any debris that is picked up by the covering 30, and assist in pick up of the paper sheets and in non-retention of the debris.

The provision of the flexing of the flat faces 32 separated by the grooves 33 circumferentially and longitudinally differs in marked respects from the compression action of a conventional roller of the type heretofore employed and on which build-up could occur. Cleaning of the rollers of the present invention is avoided thereby permitting longer runs with a better gripping action also being available.

I claim:

1. In a paper folding apparatus having at least one folding roll couple wherein at least one of the rollers comprises a core, a resilient covering of urethane secured to said core, with a durometer in the range from 60 to 70, and a plurality of ribs with flat faces separated by helical grooves on the peripheral surface of said roller.

2. A fold roller as defined in claim 1 in which said core is of steel.

3. A fold roller as defined in claim 1 in which said core has band portions contiguous its ends, and a center section of reduced diameter.

4. A fold roller as defined in claim 1 in which said grooves on the peripheral surface of said roller are of the order of sixteen to the inch lengthwise of the roller.

5. A fold roller as defined in claim 1 in which said covering is vulcanized to said core.

* * * * *

UNITED STATES PATENT AND TRADEMARK OFFICE

CERTIFICATE OF CORRECTION

PATENT NO. : 4,375,971

DATED : March 8, 1983

INVENTOR(S) : RICHARD J. MOLL

It is certified that error appears in the above-identified patent and that said Letters Patent is hereby corrected as shown below:

In the Abstract, Line 2, "rip" should be - grip -.

Signed and Sealed this

*Seventeenth* Day of *May 1983*

[SEAL]

*Attest:*

DONALD J. QUIGG

*Attesting Officer*

*Acting Commissioner of Patents and Trademarks*